US006089375A

United States Patent [19]

Johnson et al.

[11] Patent Number: 6,089,375

[45] Date of Patent: Jul. 18, 2000

[54] COMPOSITE FOOD AND CONDIMENT CONTAINER

[76] Inventors: Caroline A. Johnson; Peter C. Johnson, both of 10017 Valley View Ct., Wexford, Pa. 15097

[21] Appl. No.: 09/375,472

[22] Filed: Aug. 16, 1999

[51] Int. Cl.[7] ..... A45C 11/20

[52] U.S. Cl. ..... 206/541; 229/120.32; 229/904; 426/120

[58] Field of Search ..... 206/541, 568, 206/219–222; 229/904, 902, 400, 120.06, 120.32; 426/119, 120, 650, 386, 416

[56] References Cited

U.S. PATENT DOCUMENTS

| | | | |
|---|---|---|---|
| Re. 35,437 | 2/1997 | Ascone | 426/120 |
| 4,951,866 | 8/1990 | Rusnak | 229/904 |
| 5,012,971 | 5/1991 | Cozzi et al. | 426/120 |
| 5,209,348 | 5/1993 | Schafer, III | 206/222 |
| 5,213,256 | 5/1993 | Cyr | 229/904 |
| 5,417,364 | 5/1995 | Shaw | 229/904 |
| 5,676,244 | 10/1997 | Green et al. | 206/221 |
| 5,842,631 | 12/1998 | Berger . | |
| 5,890,648 | 4/1999 | Cai | 229/904 |

*Primary Examiner*—Paul T. Sewell
*Assistant Examiner*—Luan K. Bui
*Attorney, Agent, or Firm*—Reed Smith Shaw & McClay

[57] ABSTRACT

A composite food and condiment container is provided. The container includes an upper compartment that retains a food product and a lower compartment positioned directly below the upper compartment. The lower compartment holds a condiment. The container further includes a barrier that may be positioned in a retracted state or a non-retracted state. In the non-retracted state, the barrier separates the food product in the upper compartment from the condiment in the lower compartment. In the retracted state, the barrier exposes the food in the upper compartment to the condiment in the lower compartment.

6 Claims, 8 Drawing Sheets

COMPOSITE FOOD AND CONDIMENT CONTAINER

FIELD OF THE INVENTION

The present invention relates to a composite food and condiment container in general, a method for applying a condiment to a food product, and a method for cleanly opening a condiment package.

BACKGROUND

Many fast food restaurant food products, such as French Fries, Bread Sticks, Buffalo Wings, and Nachos, are traditionally served with a condiment. These food products are commonly served in quick scoop containers, with the accompanying condiments packaged in foil packets. This arrangement is sub-optimal for several reasons. First, because the product and the condiment are packaged separately, the user must remember to get the condiment before leaving the establishment. Second, the condiment container must be opened, and the condiment applied to the product by hand, which makes the food messy and difficult to handle. Moreover, because this activity requires two hands and two eyes, it is dangerous for those eating on the road: it impairs either their driving or their ability to apply the condiment without mess. Third, the user must dispose of the opened condiment packages, which may contain unused condiment that can leak out of the foil package.

A simpler and neater method of dispensing condiments in such situations is made possible by the composite food and condiment container of the present invention. First, the condiment is included in the package containing the food product, relieving the user from having to remember the condiments before leaving the restaurant. Second, the process of applying the condiment to the food product is greatly simplified. By pulling an extension, the user drops the food product into a condiment positioned directly below, and does not need to apply the condiment directly to the food or dip the individual food items into the condiment. Third, the condiment is applied away from the portion of the food the user is holding, reducing mess on the user's fingers. Fourth, the unused portion of the condiment is kept cleanly within the food container.

For theses reasons, there is a need for a composite food and condiment container that allows for a simpler and neater method of dispensing condiments as described in the present invention.

The composite food and condiment container described by this invention improves the convenience, cleanliness, and safety of the prior art. These benefits can be realized in many environments: at home, in school lunches and on picnics. However, these benefits are most evident at fast food restaurants, whose food products are often consumed while traveling.

SUMMARY

The present invention is directed to a composite food and condiment container. The container includes an upper compartment that retains a food product and a lower compartment positioned directly below the upper compartment. The lower compartment holds a condiment. The lower compartment may include a liner capable of preventing leakage of the condiment in the lower compartment. The lower compartment may also contain a holder for the condiment. The invention further includes a barrier consisting of a main portion and an extension. The extension extends from the main portion to the exterior of the container. The barrier may be positioned in a non-retracted state or a retracted state by a user of the container. When the barrier is in the non-retractable state, it separates the food product in the upper compartment from the condiment in the lower compartment. When this barrier is positioned in the retracted state, the food in the upper compartment is exposed to the condiment in the lower compartment.

In a particularly preferred embodiment, the composite food and condiment container has a slit in a wall of the container between the lower and upper compartment and the extension of the barrier extends outside through the slit. When a user of the present invention pulls the extension, the slit scrapes the condiment and food adhering to the barrier that is exiting the container, thus eliminating exposure of the condiment or food product to the user.

In an alternative embodiment, the composite food and condiment container has at least one double-walled side. The extension extends within the double-walled side and outside the container at the top or near the top of the double-walled side. When the user pulls the extension, the main portion that is exposed to the food product or condiment is contained within this double-walled side, thus eliminating exposure of the condiment or food product to the user.

BRIEF DESCRIPTION OF THE DRAWINGS

The features, objects, and advantages of the present invention will become more apparent from the detailed description set forth below when take in conjunction with the drawings, in which like reference characters identify correspondingly through and wherein.

DETAILED DESCRIPTION

The present invention is directed to a composite food and condiment container illustrated in FIGS. 1, 2, 3, and 4. The invention includes a container (10) consisting of an upper compartment (12) that retains a food product (not shown) and a lower compartment (14) positioned directly below the upper compartment. The lower compartment holds a condiment (also not shown). Exemplary materials for the container may include plastics or heavy paper stocks such as cardboard formed using methods well known in the art.

Figure 2:
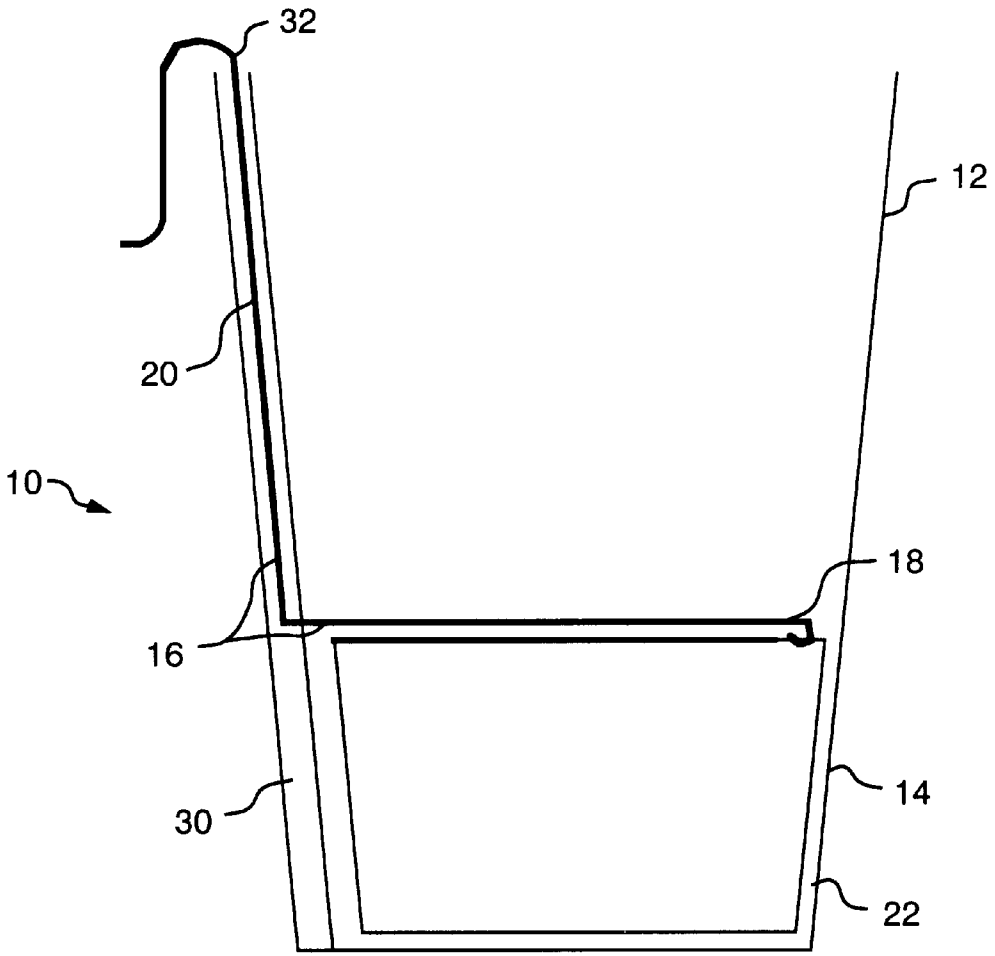
FIG. 2 is a side view of the composite food and condiment container in accordance with the present invention.
Figure 4:
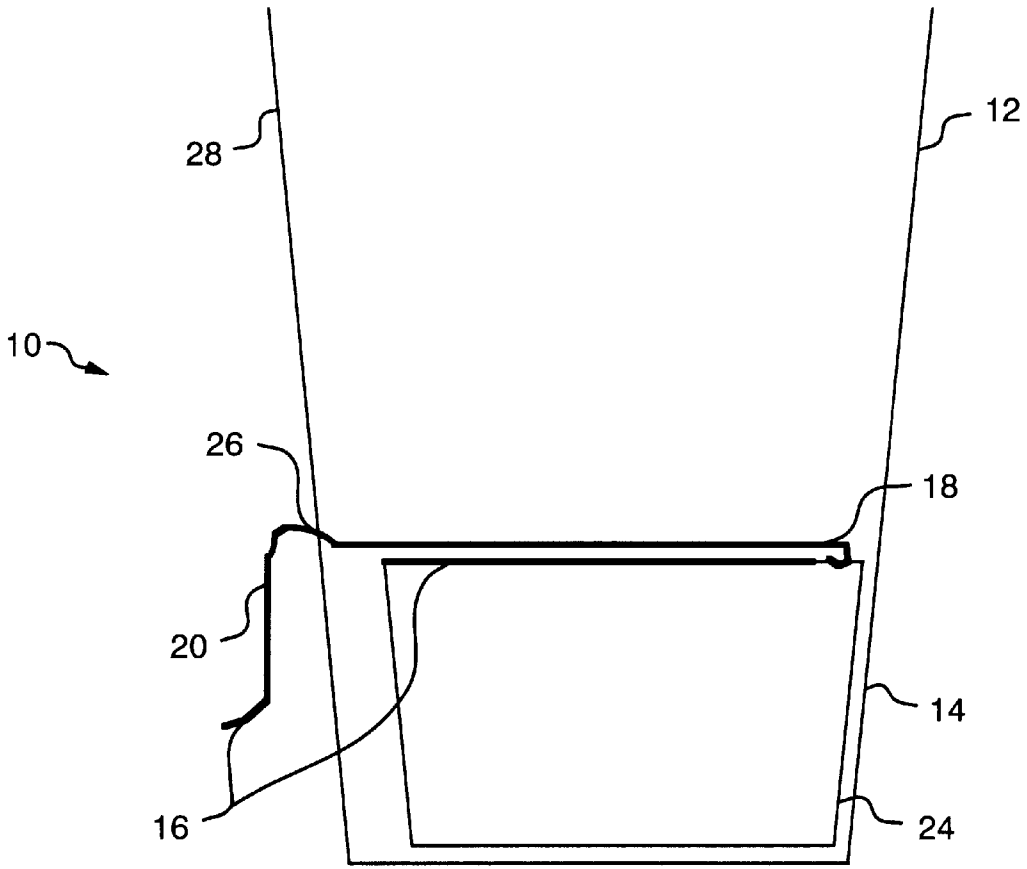
FIG. 4 is a side view of an alternative embodiment of the present invention.

The invention further includes a barrier (16) consisting of a main portion (18) and an extension (20) as illustrated in the side view of the composite food and condiment container in FIGS. 2 and 4. The extension (20) extends from the main portion (20) to the exterior of the container. This barrier (16) is retractable from a non-retracted state (shown in FIGS. 2 and 4) to a retracted state (shown in FIG. 5) by a user of the container. When the barrier (16) is positioned in the non-retractable state (shown in FIGS. 2 and 4), it separates the food product in the upper compartment from the condiment in the lower compartment. When the barrier (16) is positioned by a user of the container into the retracted state (shown in FIG. 5), the food product in the upper compartment is exposed to the condiment in the lower compartment.

In a preferred embodiment, the lower compartment may include a liner (22) capable of preventing leakage of the condiment provided therein. The lower compartment may alternatively contain a holder (24) for the condiment. The barrier includes a main portion which, in the non-retracted state, is either affixed to the side walls of the lower compartment by an adhesive or affixed to the holder of the condiment by an adhesive. The barrier may be composed of, for example, foils, waxed papers, and plastics.

Figure 3:
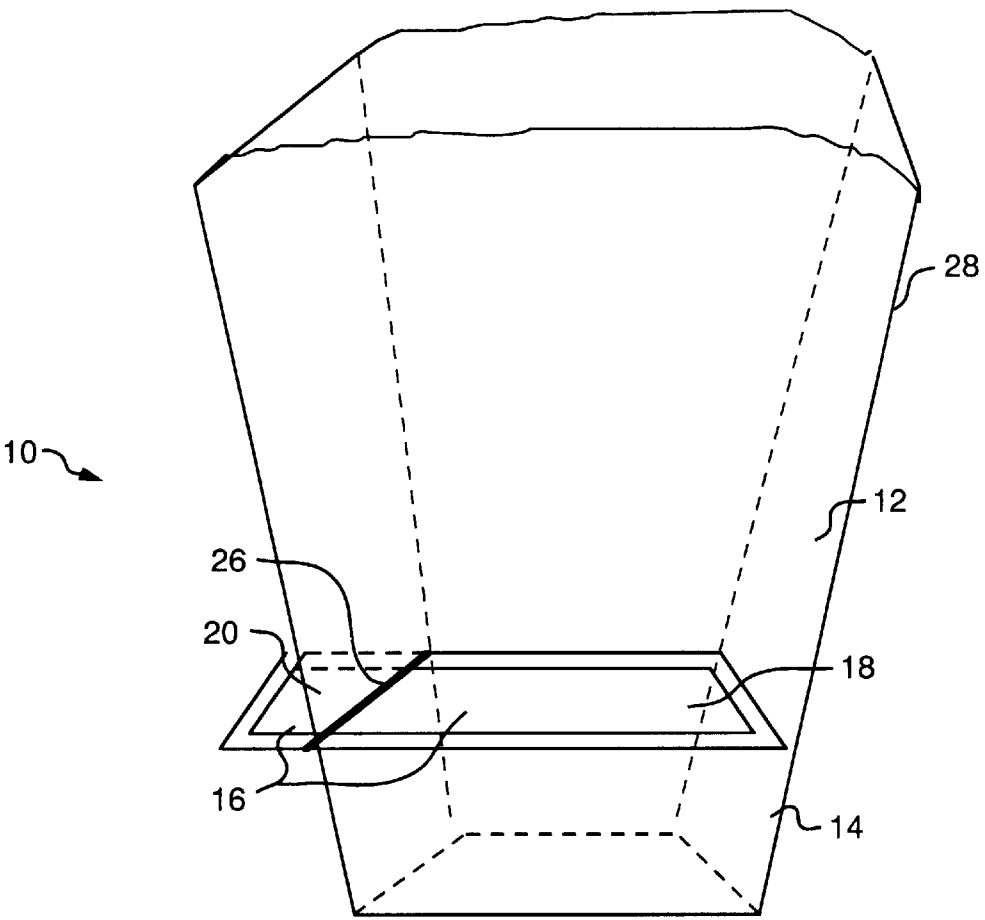
FIG. 3 is an isometric view of an alternative embodiment of the present invention.
Figure 5:
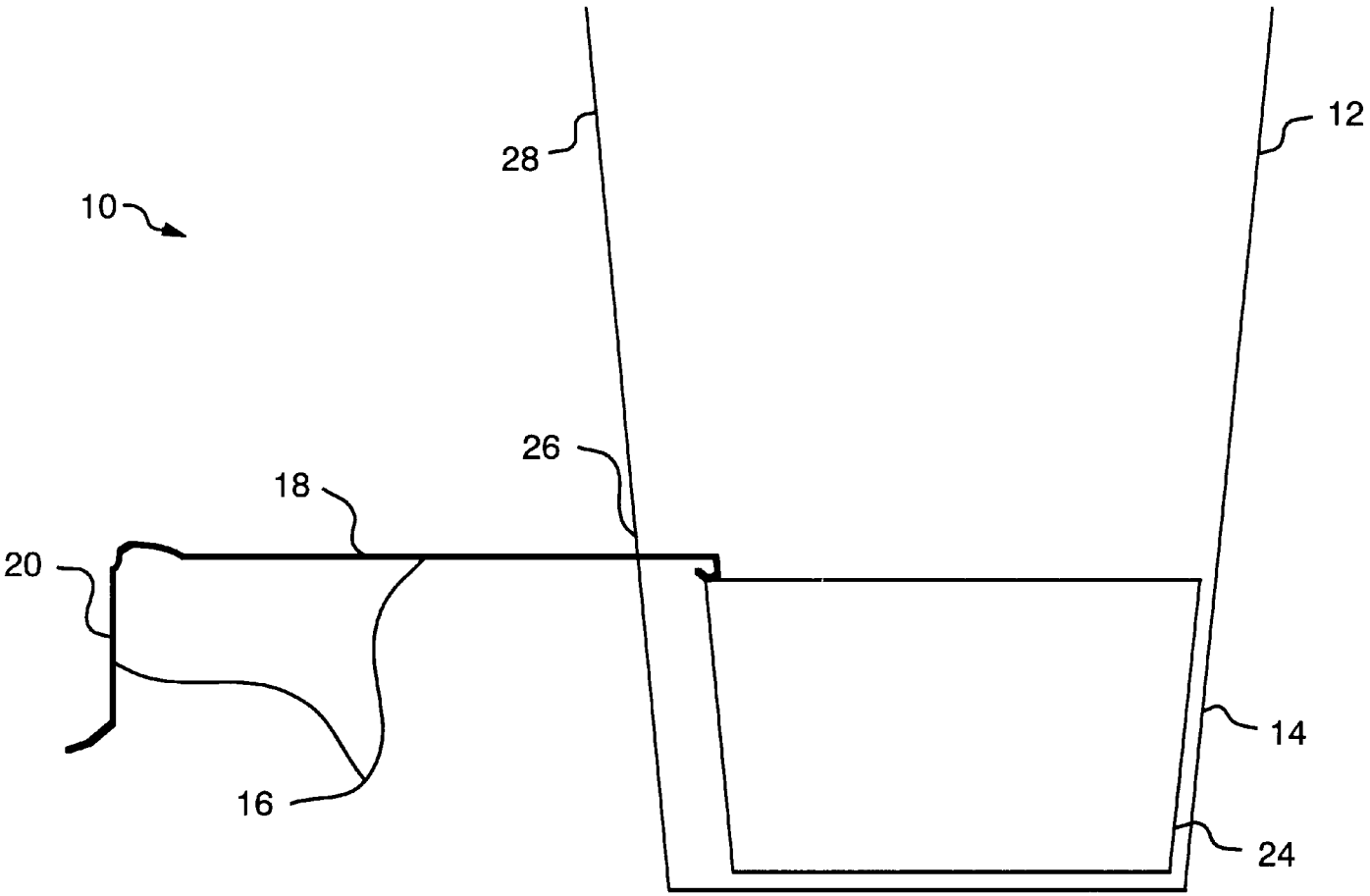
FIG. 5 is a flow diagram of a method for applying a condiment in a container in accordance with the present invention.

In a preferred embodiment, the composite food and condiment container has a slit (26) in a wall (28) of the container and the extension (20) of the barrier is threaded through the slit to outside the container as illustrated in FIGS. 3, 4 and 5.

Figure 1:
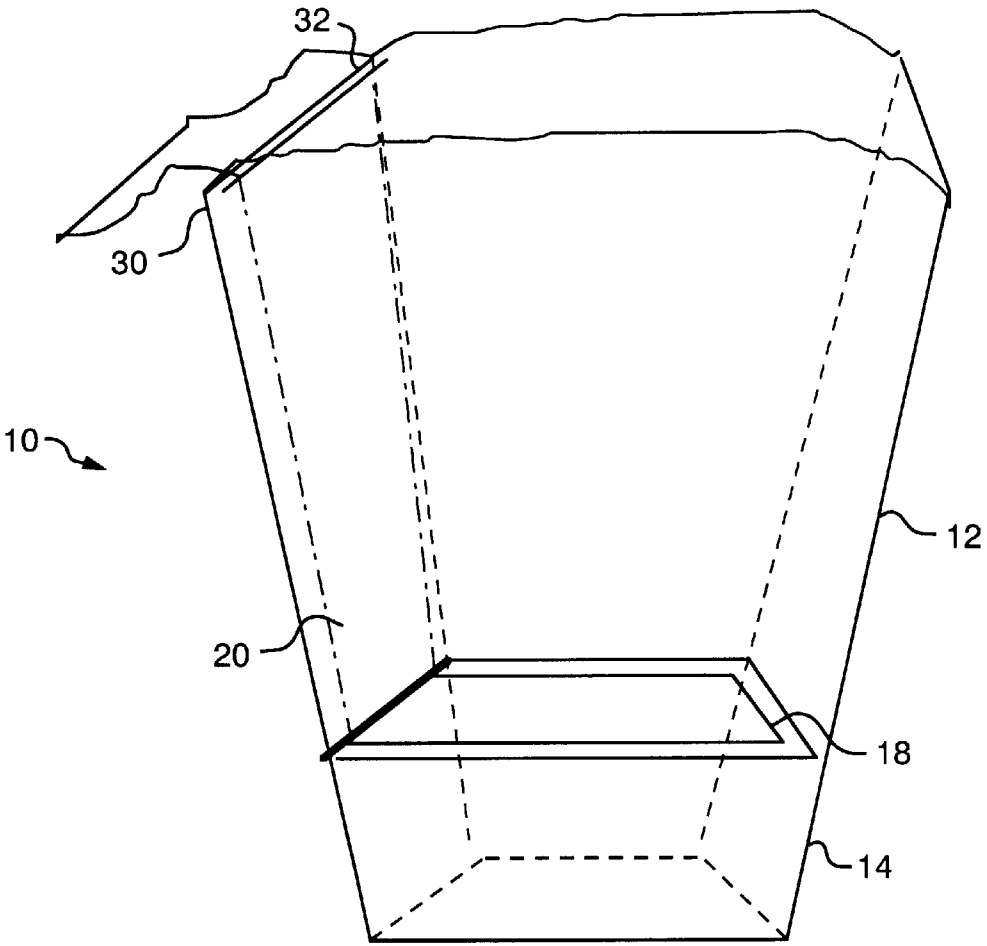
FIG. 1 is an isometric view of the composite food and condiment container in accordance the present invention.

In an alternative embodiment, the composite food and condiment container has at least one double-walled side (30) as illustrated in FIGS. 1 and 2. The extension of the barrier extends within the double-walled side and outside the container at the top (32) or near the top of the double-walled side.

Figure 6:
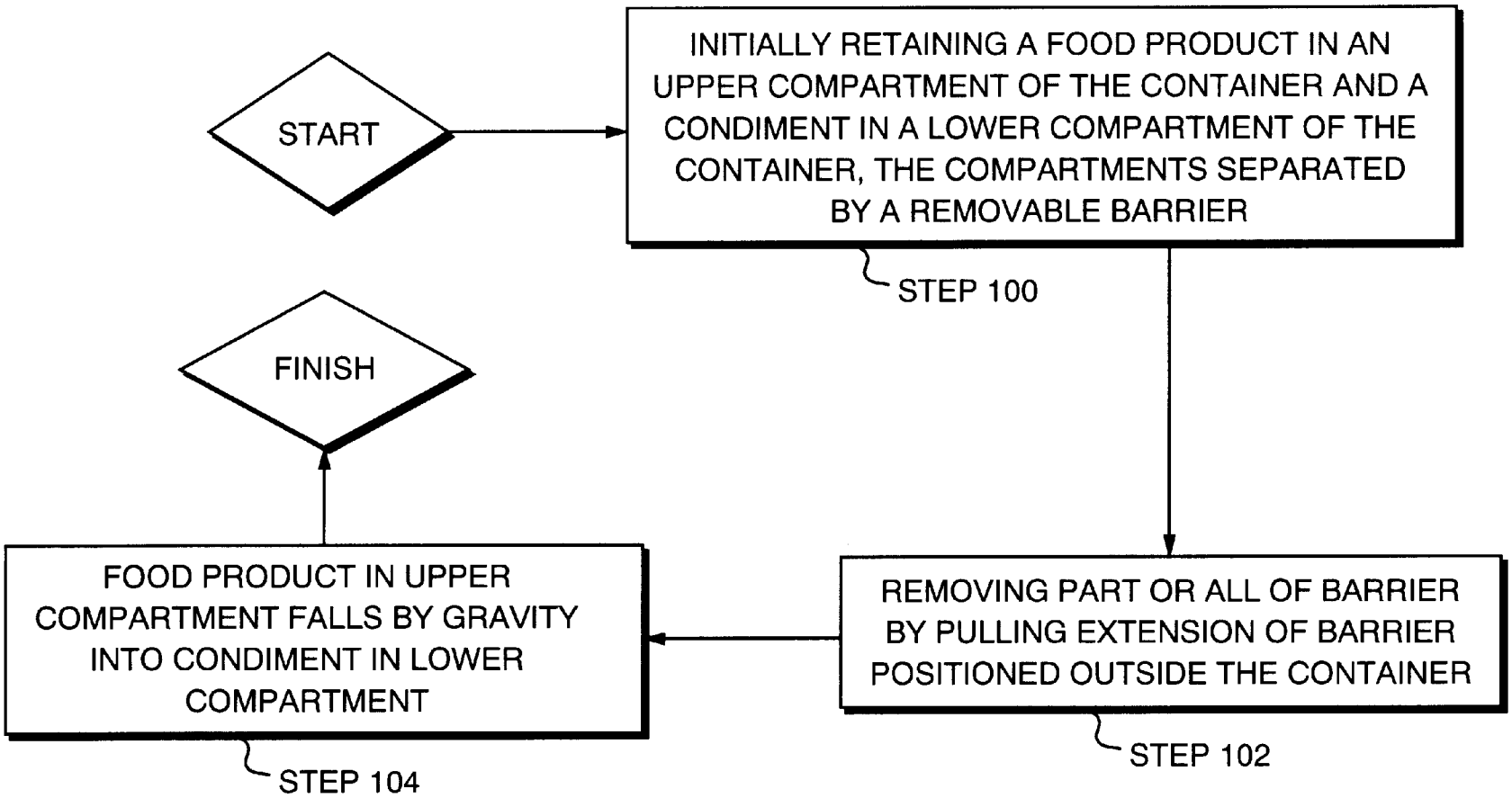
FIG. 6 is a flow diagram of a method for cleanly applying a condiment to a food product in accordance with the present invention.

In accordance with a still further aspect, the invention is directed to a method for applying a condiment to a food product as illustrated in the flow diagram in FIG. 6. A food product, located in an upper compartment of a container, and a condiment, located in a lower compartment of a container, are separated in the container by a barrier (step 100). The condiment is applied to the food product when a user of the container pulls the extension of the barrier, placing the barrier in a retracted state (step 102). The food product then falls by gravity into the condiment (step 103). The entire contents of the upper compartment can be exposed to the condiment in the lower compartment if the entire main portion of the barrier is retracted. Or, the barrier can be retracted in parts, limiting exposure of the food product to the condiment.

Figure 7:
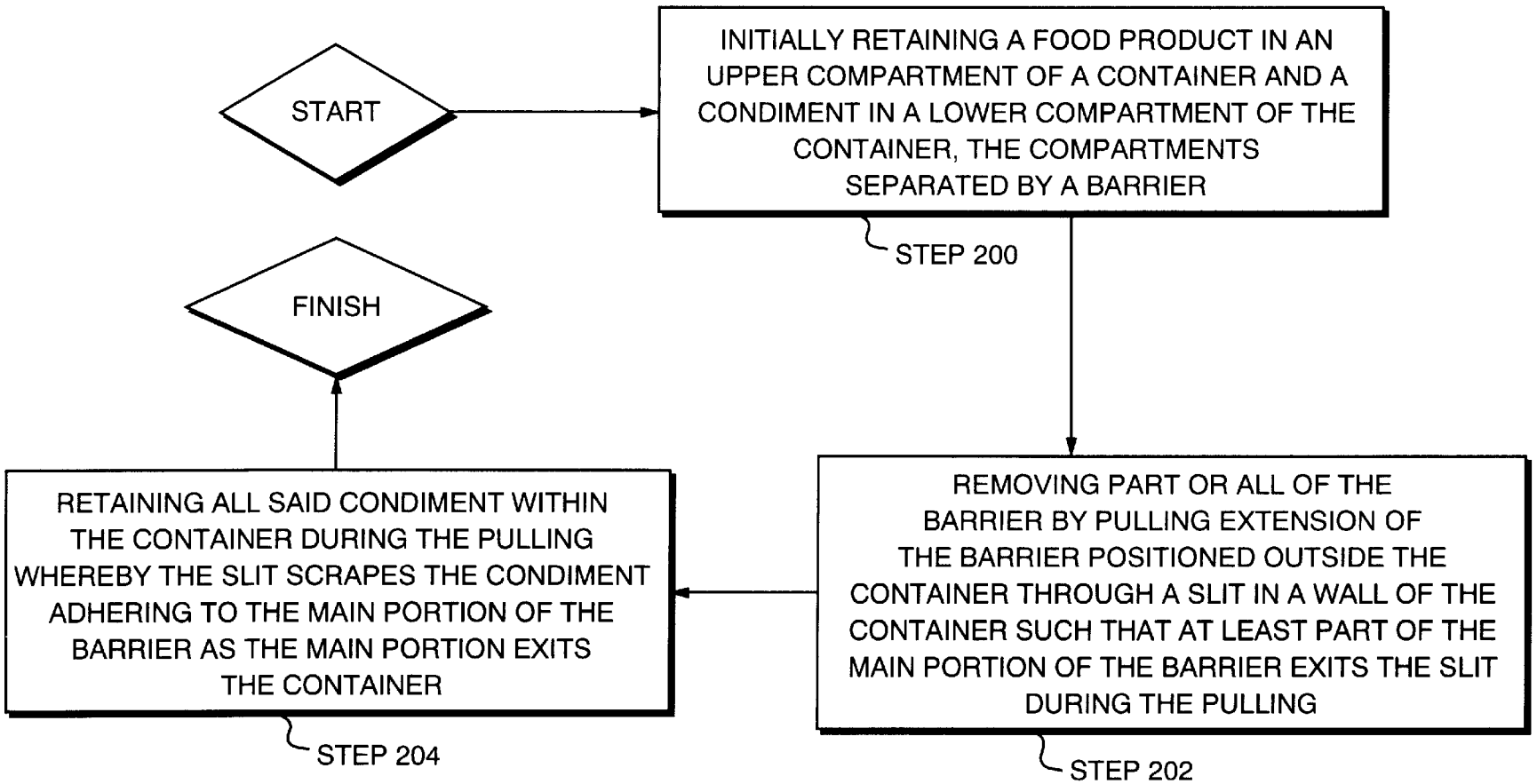
FIG. 7 is a flow diagram for an alternative method of cleanly applying a condiment to a food product in accordance with the present invention.

In accordance with a still further aspect, the invention is directed to a method for cleanly opening a condiment holder as illustrated in the flow diagram in FIG. 7. The invention includes a barrier consisting of a main portion and an extension. The extension extends from the main portion to the exterior of the container. This barrier is retractable from a non-retracted state to a retracted state by a user of the container. When this barrier is in the non-retractable state, it separates the food product in the upper compartment from the condiment in the lower compartment (step 200). The main portion of this barrier is therefore exposed to the food product and the condiment. When a user of the container pulls the barrier to the retracted state, the main portion of the barrier is exposed to outside the container through the slit (step 202). The condiment and food product however are contained within the container as this slit scrapes the condiment and food product off any part of the exposed main portion as it is pulled out of the container, thus eliminating exposure of the condiment or food product to the user (step 204).

Figure 8:
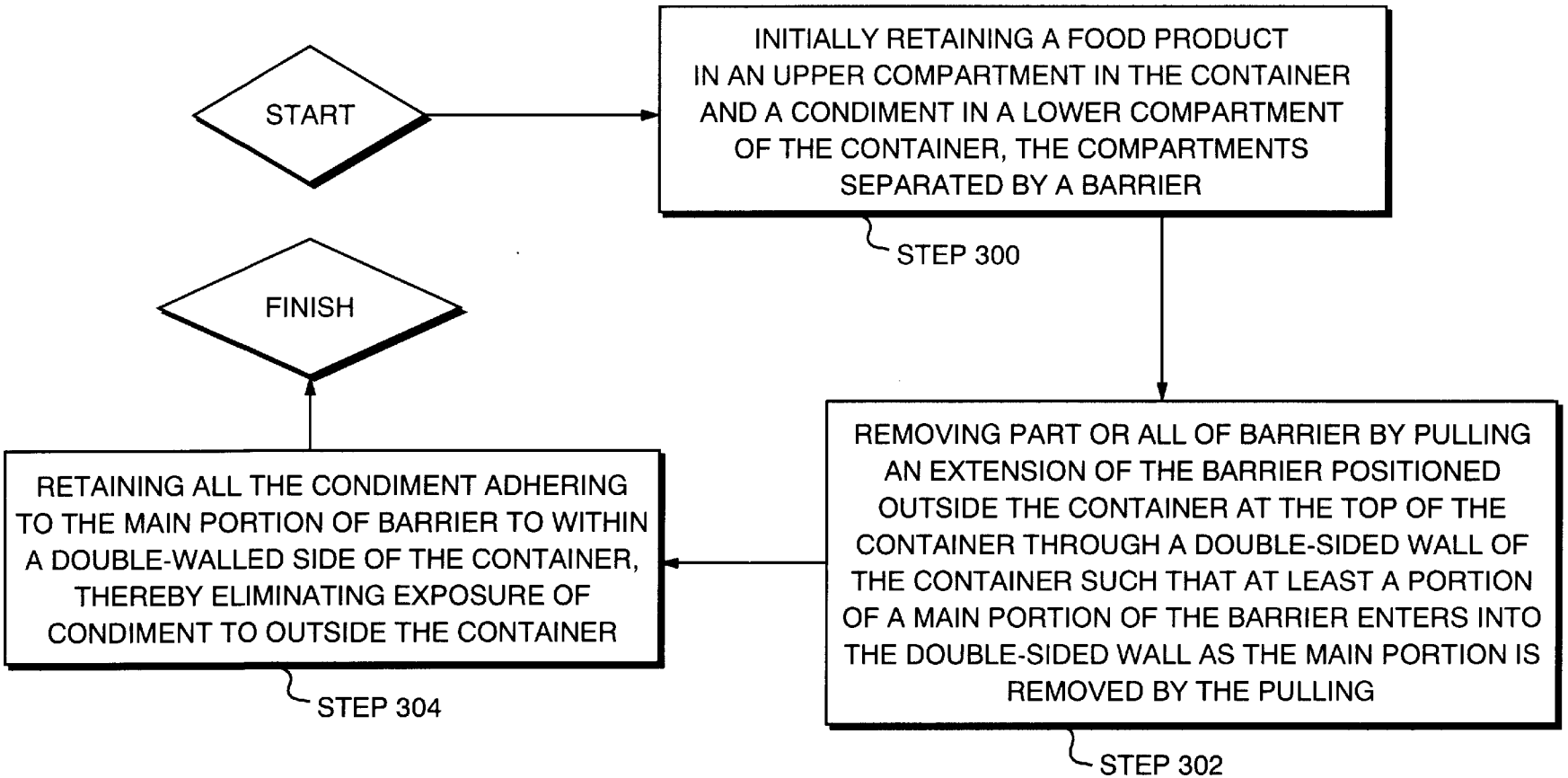
FIG. 8 is a flow diagram for a further alternative method of cleanly applying a condiment to a food product in accordance with the present invention.

Finally, in accordance with a still further aspect, the invention is directed to an alternative method of cleanly opening a condiment holder as illustrated in FIG. 8. The invention includes a barrier consisting of a main portion and an extension. The extension extends from the main portion to the exterior of the container. This barrier is retractable from a non-retracted state to a retracted state by a user of the container. When this barrier is in the non-retractable state, it separates the food product in the upper compartment from the condiment in the lower compartment (step 300). The main portion of this barrier is therefore exposed to the food product and the condiment. When a user of the container pulls the barrier to the retracted state, the main portion is pulled into a double-walled side of the container (step 302). Thus, the barrier that is exposed to the food or condiment is contained within this double-walled side, eliminating exposure of the condiment or food product to the user of the container (step 304).

The previous description of the preferred embodiments is provided to enable any person skilled in the art to make or use the present invention. The various modifications to these embodiments will be readily apparent to those skilled in the art, and the generic principles defined herein may be applied to the other embodiments without the use of inventive faculty. Thus, the present invention is not intended to be limited to the embodiments shown herein but is to be accorded the widest scope consistent with the principles and novel features disclosed herein.

What is claimed is:

1. A composite food and condiment container comprising;

a. an upper compartment that retains a food product;

b. a lower compartment positioned directly below said upper compartment;

c. a holder containing a condiment, said holder being enclosed within the lower compartment; and d. a barrier comprising a main portion and an extension which extends from said main portion to an exterior of said container, wherein said barrier may be positioned in a retracted state or a non-retracted state by a user of said container, wherein said barrier separates said food product in said upper compartment from said condiment in said lower compartment when said barrier is in the non-retracted state, wherein said food product in said upper compartment is exposed to said condiment in said lower compartment when said barrier is in the retracted state, and wherein a user of the container moves the barrier from the non-retracted state to the retracted state by pulling on said extension;

wherein said holder is sealed by said main portion of said barrier when the barrier is in the non-retracted state.

2. A composite food and condiment container as recited in claim 1, in which the lower compartment further comprises:

a liner capable of preventing leakage of said condiment.

3. A composite food and condiment container as recited in claim 1, further comprising:

e. a slit provided in a wall of said container between said upper compartment and said lower compartment; and f. said extension extends outside said container through said slit.

4. A method for cleanly opening a condiment package positioned within a container comprising the steps of:

a. initially retaining a food product in an upper compartment in said container, and, initially retaining a condiment in a lower compartment of said container, wherein said upper compartment and said lower compartment are separated by a barrier, said barrier consisting of a main portion and an extension, wherein said main portion separates the upper compartment from the lower compartment and said extension extends from said main portion to outside said container; wherein said main portion acts as the sealer for said condiment package;

b. removing in part or in toto said barrier by pulling said extension; wherein at least a portion of said main portion exits outside said container through a narrow slit in a wall of said container during said pulling; and c. retaining all said condiment within said container during said pulling, whereby the slit scrapes said condiment adhering to said main portion of said barrier as said main portion of said barrier exits said container.

5. A method for cleanly opening a condiment package positioned within a container comprising the steps of:

a. initially retaining a food product in an upper compartment in said container, and, initially retaining a condiment in a lower compartment of said container, wherein said upper compartment and said lower compartment are separated by a barrier, said barrier consisting of a main portion and an extension; wherein said main portion separates the upper compartment from the lower compartment and said extension extends from said main portion to outside said container, wherein said extension of said barrier extends within a double-walled side and extends outside said container at the top of said double-walled side, wherein said main portion acts as a sealer for said condiment package;

b. removing in part or in toto said barrier by pulling said extension, wherein at least a portion of said main portion enters into said double-walled side as the main portion is removed by said pulling; and c. retaining all said condiment adhering to said main portion to within the container by allowing said main portion to extend to within said double-walled side upon pulling of said extension.

6. A composite food and condiment container comprising;

a. an upper compartment that retains a food product;

b. a lower compartment positioned directly below said upper compartment, wherein said lower compartment holds a condiment;

c. a barrier comprising a main portion and an extension which extends from said main portion to an exterior of said container, wherein said barrier may be positioned in a retracted state or a non-retracted state by a user of said container, wherein said barrier separates said food product in said upper compartment from said condiment in said lower compartment when said barrier is in the non-retracted state, wherein said food product in said upper compartment is exposed to said condiment in said lower compartment when said barrier is in the retracted state, and wherein a user of the container moves the barrier from the non-retracted state to the retracted state by pulling on said extension; and d. at least one double-walled side of said container, wherein said extension of said barrier extends within the double-walled side and extends outside said container at the top of said double-walled side.

* * * * *